US005902063A

United States Patent [19]

Lhuisset et al.

[11] Patent Number: 5,902,063

[45] Date of Patent: May 11, 1999

[54] CONTAINER WITH BRUSH FOR THE APPLICATION OF A PRODUCT SUCH AS MASCARA

[75] Inventors: Francois Lhuisset, Montgeron; Bernard Clerget, Haudivillers; Yvon Cochez, Beauvais, all of France

[73] Assignee: LVMH Recherche, Nanterre, France

[21] Appl. No.: 09/029,985

[22] PCT Filed: Sep. 13, 1996

[86] PCT No.: PCT/FR96/01426

§ 371 Date: Jun. 8, 1998

§ 102(e) Date: Jun. 8, 1998

[87] PCT Pub. No.: WO97/09904

PCT Pub. Date: Mar. 20, 1997

[30] Foreign Application Priority Data

Sep. 14, 1995 [FR] France ..... 95 10774

[51] Int. Cl.[6] ..... A46B 11/00

[52] U.S. Cl. ..... 401/122; 132/218; 401/129

[58] Field of Search ..... 401/122, 121, 401/129, 126, 130, 128; 132/218

[56] References Cited

U.S. PATENT DOCUMENTS

| | | | |
|---|---|---|---|
| 3,921,650 | 11/1975 | Montogomery | 401/128 X |
| 3,930,280 | 1/1976 | Vasas | 401/122 X |
| 4,261,376 | 4/1981 | Kingsford | 132/218 |
| 4,810,122 | 3/1989 | Cole | 401/122 |
| 5,309,929 | 5/1994 | Toll | 401/122 X |

FOREIGN PATENT DOCUMENTS

| | | |
|---|---|---|
| 0204466 | 12/1986 | European Pat. Off. . |
| 2222048 | 10/1974 | France . |

*Primary Examiner*—David J. Walczak
*Assistant Examiner*—Kathleen J. Prunner
*Attorney, Agent, or Firm*—Leydig, Voit & Mayer

[57] ABSTRACT

A container with a brush for the application of a product such as mascara includes a scraping sleeve made fast to the neck of the container and which forms at least one constriction permitting the insertion of the brush into the container and its dry-squeezing during withdrawal from the container. The constriction extends transversely inside of the sleeve and defines on either side of the constriction a chamber through which a stem of the brush passes and another chamber opposite to the brush receiving chamber into which the free ends of the bristles are received. The bristles being squeezed while passing through the constriction. The transverse dimension of the constriction is smaller than the length of the bristles so that a certain amount of the product can be retained on the ends of the bristles while the portion of the bristles in the constriction is dry-squeezed.

7 Claims, 4 Drawing Sheets

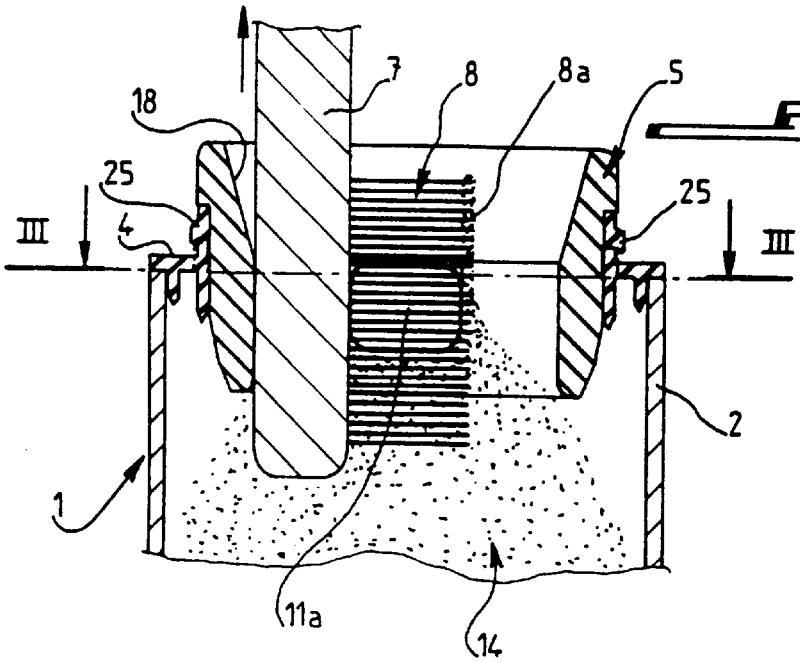
FIG. 2
FIG. 3
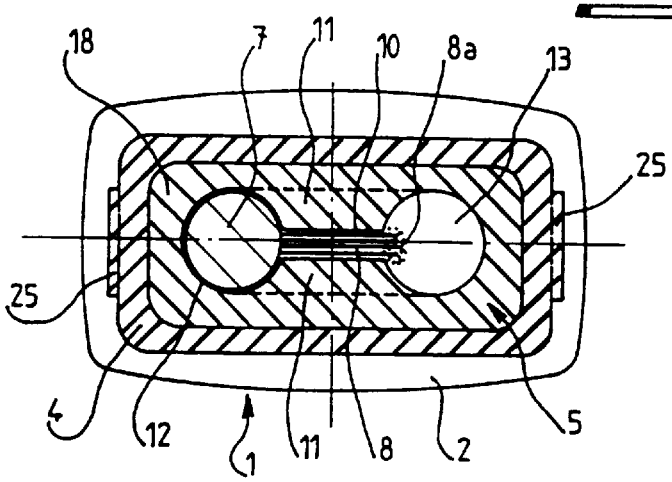
FIG. 4
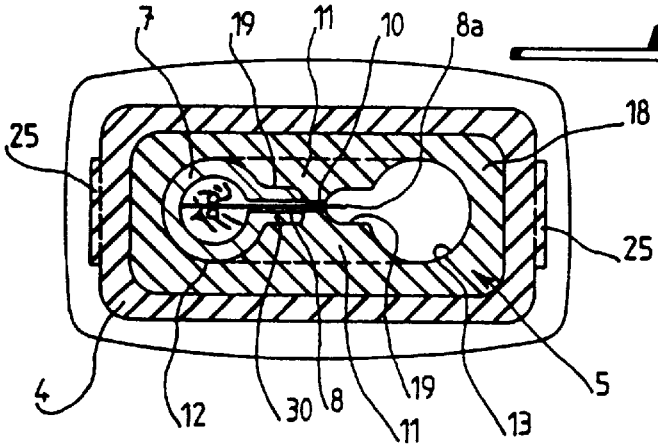
FIG. 5
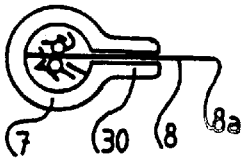

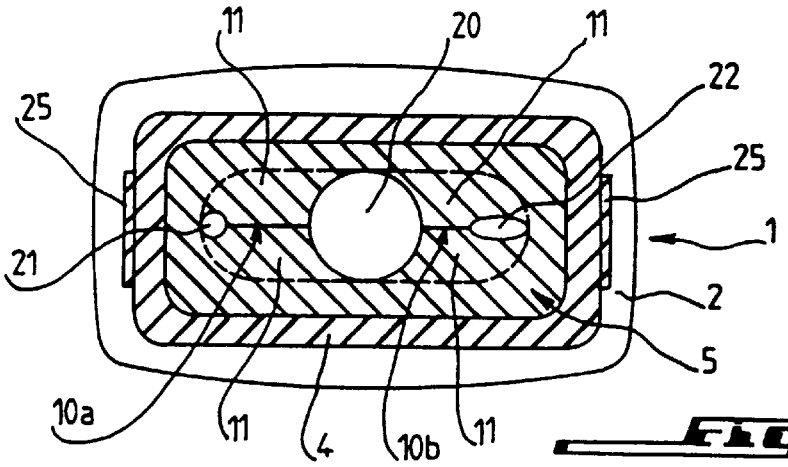
Fig. 6
Fig. 7
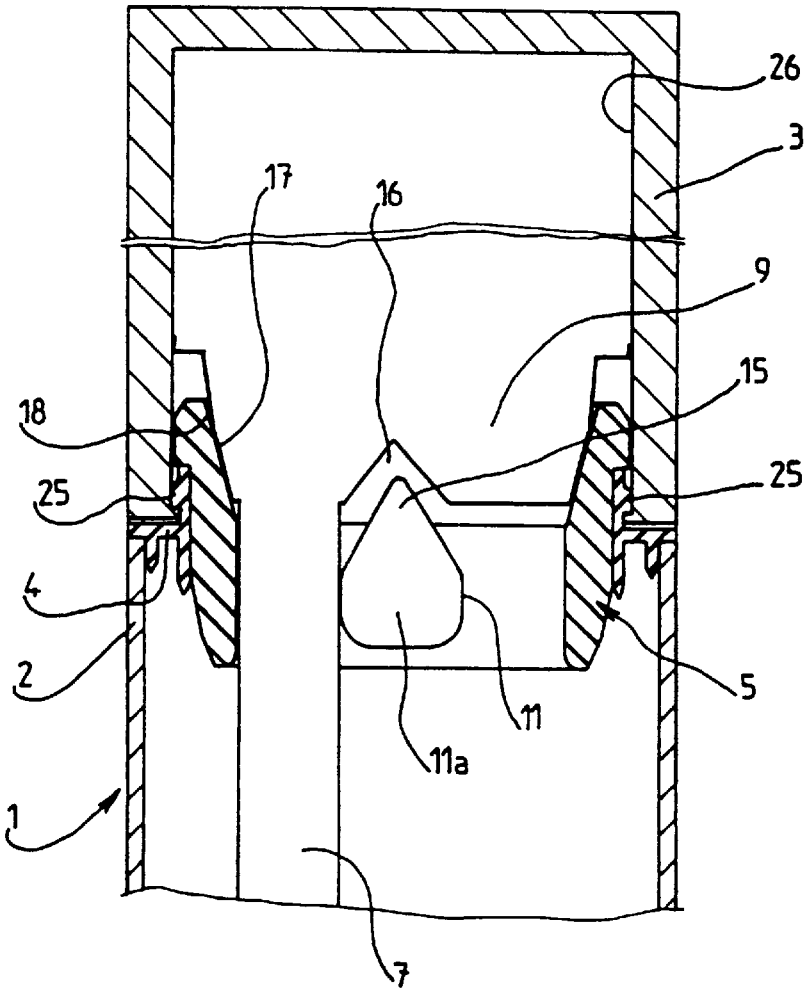

CONTAINER WITH BRUSH FOR THE APPLICATION OF A PRODUCT SUCH AS MASCARA

The present invention has essentially as its subject a container with a brush in particular permitting the application of a more or less viscous liquid product upon any surface such for example as mascara upon the lashes of the eye.

There has already been proposed to provide the neck of a mascara container or bottle with a means for the scraping of the brush, this scraping means permitting the insertion of the brush into the container as well as its dry-squeezing during its withdrawal from the container.

The constriction permitting the scraping was generally constituted by a deformation of the wall of the sleeve which could be freely rotatably mounted into the neck of the container.

However, the rotation of the scraping sleeve within the neck of the container could exhibit problems as well as the insertion of the brush and its withdrawal through the sleeve.

The present invention has as its object to remedy these inconveniences in particular by proposing an improved scraping means which permits a controlled dry-squeezing of the brush in the sense that it could be extracted from the container while being dry-squeezed but while still containing at the end of the bristles a controlled amount of product such as mascara contained in the container.

For that purpose, the invention has as its subject a container with a brush for the application of mascara for example and of the type comprising a scraping means made fast to the neck of the container and constituted by a sleeve the wall of which forms at least one constriction permitting the insertion of the brush into the container as well as its dry-squeezing during its withdrawal from the container, characterized in that the said constriction extends transversely inside of the sleeve so as to define therewith on either side of the constriction, a chamber or the like for the passage of the stem of the brush and another chamber or the like opposite to that cited in the first place and into which are projecting the free ends of the bristles of the brush the length of which is greater than the transverse dimension of the constriction.

According to another characteristic of the invention on either side of the aforesaid construction is provided a concavity communicating with one or the other chamber and in which is accommodated an excrescence of the stem of the brush, which excrescence has in cross-section a shape corresponding to that of the said concavity.

According to another embodiment, one provides in the sleeve two constrictions defining between them and with the said sleeve a chamber or the like for the passage of the stem of the brush and opposite to this chamber, two other chambers into which are projecting the free ends of the bristles of the brush.

One should further specify here that above at least one constriction is provided in the sleeve a snug or the like for the guidance during the insertion of the stem of the brush.

The upper portion of the sleeve preferably exhibits a conicity with a shape corresponding to that of the support of the stem of the brush, which support forms a closure cap for the container.

According to still another characteristic of the invention, the aforesaid constriction is constituted by at least two bosses projecting inside of the sleeve and the mutually confronting portions of which defining the said constriction are either flat substantially parallel surfaces or surfaces with a more complex for example polygonal shape.

The chambers for the passage of the stem of the brush exhibit a shape in cross-section corresponding substantially to that of the said stem and this in such a manner that the rotation of the stem of the brush about its axis be prevented.

But further advantages and characteristics of the invention will appear better in the detailed description which follows and refers to the attached drawings given by way of example only and in which:

FIG. 2 is a view similar to FIG. 1 but showing the brush in the process of being dry-squeezed during its extraction from the container;

FIG. 3 is a view in cross-section along the line III—III of FIG. 2;

Figure 1:
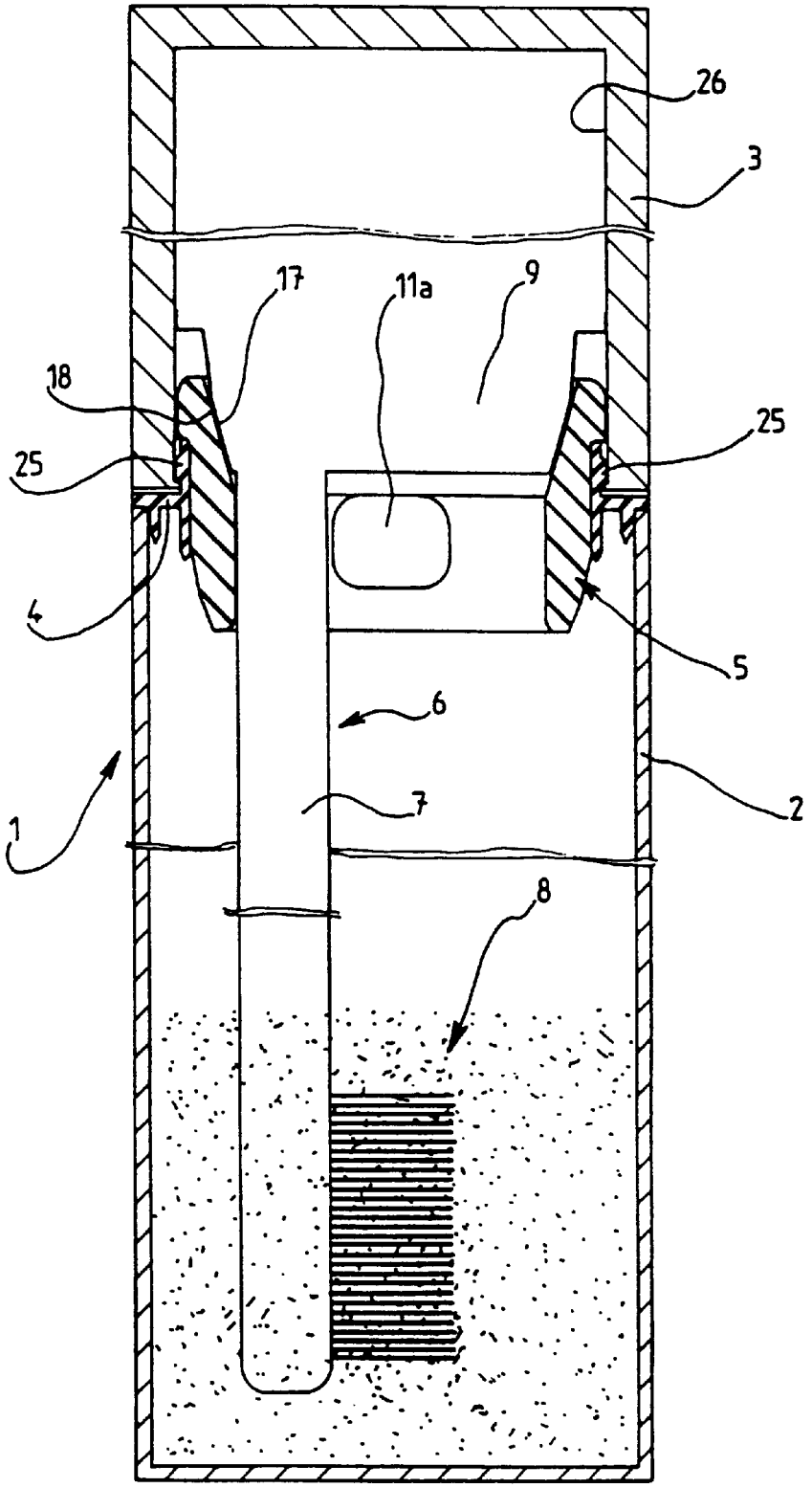
FIG. 1 is a view in axial section of a container according to the invention closed by a stopper cap carrying a brush dipping into the product contained in the container.
Figure 8:
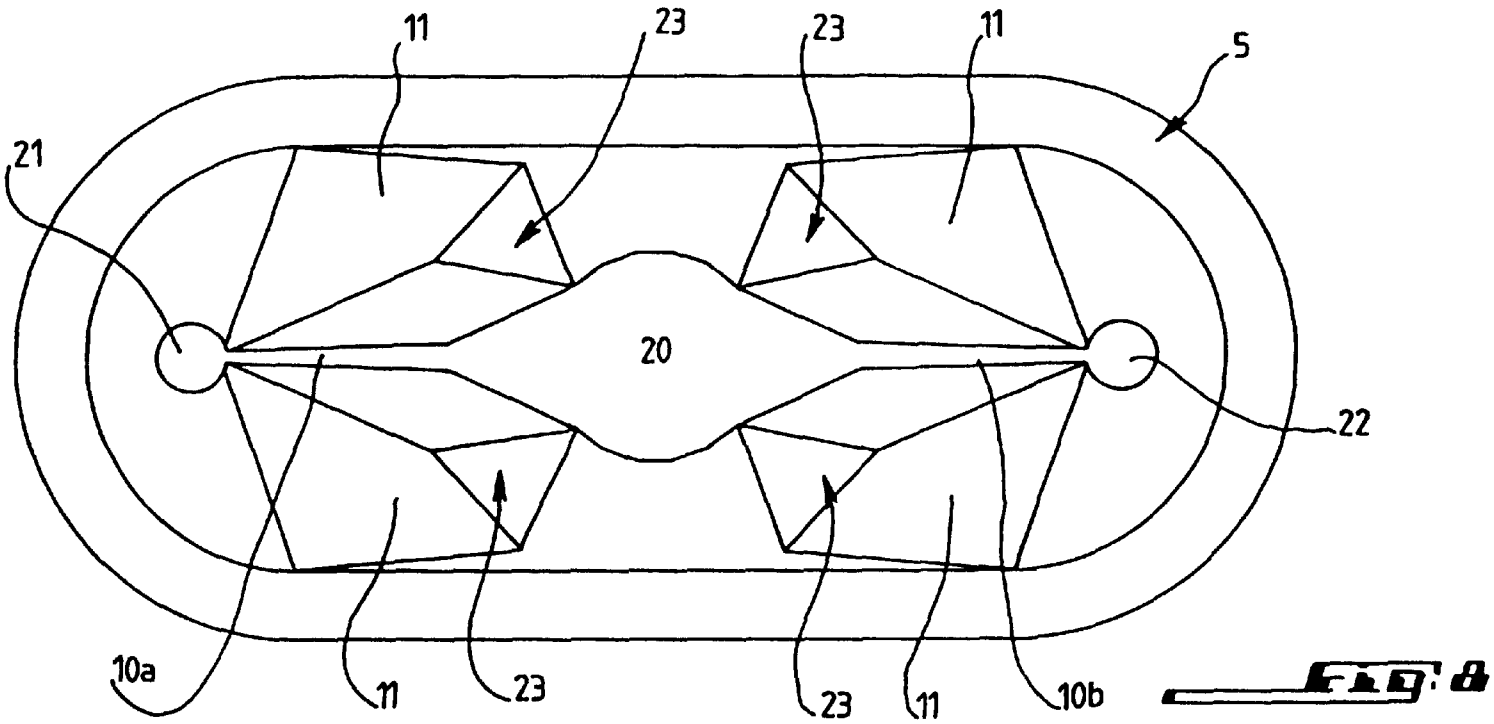
Figure 9:
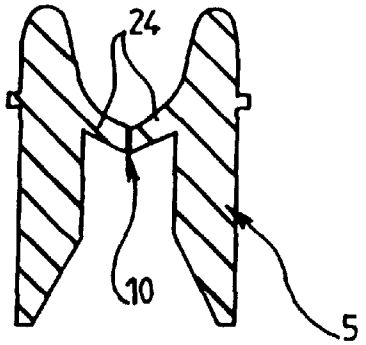

FIG. 4 also is a view in cross-section similar to FIG. 3 but showing another embodiment of constriction;

FIG. 5 is a view in cross-section of a brush adapted to be used with a container the neck of which is provided with a constriction according to that of FIG. 4;

FIG. 6 illustrates in cross-section another embodiment of sleeve with two constrictions for the dry-squeezing of the brush;

FIG. 7 is a view similar to FIG. 1 but illustrating a sleeve with a snug for the guiding of the stem of the brush during the insertion into this sleeve;

FIG. 8 is a top view illustrating a sleeve with two constrictions akin to that shown on FIG. 6 but the constrictions of which are formed of bosses with a complex shape;

FIG. 9 is a view in axial section of another embodiment of sleeve with a constriction with flexible lips.

One sees on FIGS. 1, 2 and 7 in particular an exemplary embodiment of container 1 the body 2 of which forms a storage tank for a product such as mascara and the upper portion of which forms a neck which may be closed by a stopper cap 3.

The neck of the container 1 is formed of a flange or the like 4 mounted by any suitable means at the upper portion of the body 2 and onto which is fastened a sleeve 5 permitting the insertion of a brush 6 constituted by a stem 7 ending with a group of filaments or bristles 8 extending according to the example shown in one single direction.

The stem 7 of the brush 6, on the side opposite to the bristles 8 which extend unidirectionally, is made fast to a support 9 forming part of the stopper cap 3.

According to the invention and as one sees it better on FIG. 3, the sleeve 5 comprises a constriction 10 which extends transversely inside of the sleeve 5 and which consists according to the example shown of two opposite bosses 11 located approximately in the middle of the opening defined by the sleeve 5 and projecting inwards of this sleeve. Thus on either side of the constriction 10 and with the internal wall of the sleeve 5 are defined two chambers denoted 12 and 13, respectively. Either one of the chambers 12, 13 permits the passage of the stem 7 of the brush to insert it into the body 2 of the container 1 or to extract it therefrom in order to dry-squeeze it. On FIG. 3 one sees that it is the chamber 12 which for example permits the passage of the stem 7 of the brush, it being understood that the other chamber 13 could perfectly perform the same function.

On FIG. 3 and also on FIG. 2 one sees that according to an important characteristic of the invention, the length of the bristles 8 of the brush is slightly greater than the transverse dimension of the constriction 10 formed by the bosses 11 so that when the stem 7 of the brush is accommodated in one 12 of the two chambers, the bristles are projecting into the other chamber 13 with their free ends 8*a*. In this manner as one sees it well on FIG. 2, when one dry-squeezes the brush 6 by withdrawing it from the sleeve 5, the ends 8*a* of the bristles 8 not affected by the constriction 10 remain loaded with a certain amount of product 14 such as mascara contained in the body 2 of the container 1. Thus, the make-up of the eye-lashes could be effected in an efficient manner as one understands it, it being understood that the length of the bristles 8 and/or the transverse dimension of the constriction 10 could be selected and set to any value as a function of the amount and of the density of mascara 14 which one wants to retain at the end 8*a* of the bristles 8.

According to the exemplary embodiment visible on FIGS. 1 to 3, the mutually confronting portions of the bosses 11 defining the constriction 10 are constituted by substantially flat and parallel surfaces designated at 11*a* on FIGS. 1, 2 and 7.

On FIG. 7 one has shown at 15 a snug or the like which in a way extends the bosses 11 upwards so as to promote the guiding of the stem 7 of the brush 6 during its insertion into the container 1. One has further shown on FIG. 7 a notch or the like 16 provided in the support 9 of the brush 6 made fast to the stopper cap 3, this notch forming in a way a recess for accommodating the said support at the end of the insertion of the brush into the container 1.

One should further note here that the support 9 of the stem 7 of the brush exhibits a certain conicity well visible at 17 on FIGS. 1 and 7 and which corresponds to a conicity with the same shape provided at the upper portion of the sleeve 5 as this is designated at 18 on the figures. Thus, the conicity of the support 9 of the brush and of the sleeve 5 advantageously adds itself to the presence of the snug 15 to facilitate the insertion of the brush into the container 1.

In the embodiment illustrated by FIG. 4, one sees that the mutually confronting bosses 11 defining the constriction 10 have a shape different from that of the bosses 11 visible on FIG. 3 due to the fact that they exhibit on either side of the constriction a recess or a cavity 19 communicating on the one side with the chamber 12 and on the other side with the chamber 13. Thus such a concavity could receive an excrescence 30 of the stem 7 of the brush, this excrescence 30 exhibiting in cross-section a shape corresponding exactly to that of the concavity 19 as one sees it well on FIGS. 4 and 5. Otherwise said, the bristles 8 of the brush are here backed by a particular stem structure which advantageously avoids the depositing of product along the brush. Moreover, one should note that such a structure prevents the rotation of the brush in the sleeve 5 and positions, while guiding it, the group of bristles 8 plumb with the constriction 10. Here again one sees that the mass of bristles 8 has a length greater that the transverse dimensions of the constriction 10.

In the embodiment of FIG. 6, one sees that the bosses 11 here define two constrictions denoted 10*a* and 10*b*, respectively. These two constrictions 10*a*, 10*b* define between them and with the sleeve 5 a chamber 20 for the passage of the stem of the brush (not shown here). Opposite to this chamber 20 and on the other side of both constrictions 10*a*, 10*b* are formed two other chambers 21, 22 into which may project the free ends of the bristles 8 of the brush once inserted into the chamber 20.

One therefore understands that the brush used with this embodiment could be a brush comprising two opposite groups or sheets of bristles the free ends of which will project into the chambers 21 and 22, respectively. This having been said, one could perfectly use a brush with one single group of bristles as shown on FIGS. 1 to 3 and the free ends of which will project either into the chamber 21 or into the chamber 22. This means that the presence of the free end 8*a* of the bristles 8 in the chamber 21 or in the chamber 22 corresponds in this case to a difference of 180° in the angular position of the brush.

As with the embodiment of FIGS. 1 to 3 or also of FIG. 4, the mutually confronting portions of both pairs of bosses 11 could be flat and substantially parallel surfaces.

As this clearly appears on FIG. 8, the mutually confronting surfaces 23 of both pairs of bosses 11 could also without leaving the scope of the invention be surfaces with a more complex shape such as a polygonal shape and this in order in particular to facilitate the guiding during the insertion and the withdrawal of the brush and to preserve the quality and the life of the bristles of the brush as well as their capacity to retain a certain amount of mascara in a controlled manner at their free ends.

In the embodiment of FIG. 9, the constriction 10 inside of the sleeve 5 is quite merely constituted by flexible lips 24 with co-operating free ends, thereby having the advantage of providing a differential scraping while however noting that the extraction of the brush from the container will in this case be more difficult than its insertion into the container.

In the embodiment illustrated by FIGS. 1 to 3, the chambers 12 and 13 into which may be indifferently inserted the stem 7 of the brush 6, are shown as having in cross-section a circular shape. But one could perfectly without departing from the scope of the invention provide for these chambers a shape other than circular, for example an oval shape or even a polygonal shape, the stem of the brush exhibiting in cross-section a corresponding shape so that it will be prevented from turning about its axis and that the sheet of bristles 8 will be vertically and positively guided in the constriction 10 as this is the case in the embodiment of FIG. 4.

One should further note that the stopper cap 3 supporting the brush 6 could be advantageously clipped onto the body 2 of the container 1. For that purpose the flange 4 carrying the sleeve 5 comprises possibly deformable snugs, tongues or the like 25 which may elastically co-operate with the internal wall 26 of the stopper cap 3 on the mounting or on the removal of this stopper cap.

One has thus provided according to the invention a container for mascara with a dry-squeezing sleeve integrated into the neck of the container and permitting the retention of a suitable mascara batch at the end of the bristles of the brush after dry-squeezing of this brush.

The invention is of course not at all limited to the embodiments described and illustrated which have been given by way of example only.

Thus the shape and the number of bosses defining the constriction in the sleeve of the container as well as the shape of the chambers into which pass the free ends of the bristles of the brush may have any shape and dimensions so as to be able to modulate the amount of product or of mascara loaded onto the free ends of the bristles of the brush.

Therefore, the invention comprises all the technical equivalents of the means described as well as their combinations if the latter fall within the scope of the claims which follow.

What is claimed is:

1. Container with a brush having a stem with bristles extending laterally therefrom for the application of mascara and of the type comprising a scraping means made fast to the neck of the container and constituted by a sleeve (5) the wall of which forms at least one constriction permitting the insertion of the brush (6) into the container (1) as well as its dry-squeezing during its withdrawal from the container (1), characterized in that the said constriction (10,10*a*,10*b*) extends transversely inside of the sleeve (5) so as to define with the latter on either side of the constriction a chamber (12,20) for the passage of the stem (7) of the brush and another chamber (13,21,22) opposite to that cited in the first place and into which are projecting the free ends (8*a*) of the bristles (8) of the brush (6) a length of which is greater than the transverse dimension of the constriction (10,10*a*,10*b*).

2. Container according to claim 1, characterized in that on either side of the aforesaid constriction (10) is provided a concavity (19) communicating with either chamber (12,13) and in which is accommodated an excrescence (30) of the stem (7) of the brush, which excrescence has in cross-section a shape corresponding to that of the said concavity (19).

3. Container according to claim 1, characterized by two constrictions (10*a*,10*b*) defining therebetween and with the sleeve (5) a chamber (20) for the passage of the stem (7) of the brush and opposite to this chamber two other chambers (21,22) into which are projecting the free ends (8*a*) of the bristles (8) of the brush.

4. Container according to claim 1, characterized in that above at least one constriction (10) is provided in the sleeve (5) a snug (15) for the guiding during the insertion of the stem (7) of the brush into the container.

5. Container according to claim 1, characterized in that the upper portion of the sleeve (5) exhibits a conicity (18) with a shape corresponding to that of the support (9) of the stem (7) of the brush, which support forms a stopper cap (3) for the container (1).

6. Container according to claim 1, characterized in that the aforesaid constriction (10,10*a*,10*b*) is constituted by at least two bosses (11) projecting inside of the sleeve (5) and the mutually confronting portions of which defining the said constriction are either flat substantially parallel surfaces (11*a*) or surfaces (23) with a more complex shape.

7. Container according to claim 1, characterized in that the aforesaid chambers (12,13,20) for the passage of the stem (7) of the brush have a shape in cross-section corresponding to that of the said stem for preventing the rotation of this stem (7) about its axis.

* * * * *